US010724401B2

(12) United States Patent
Roussille et al.

(10) Patent No.: US 10,724,401 B2
(45) Date of Patent: Jul. 28, 2020

(54) TURBINE RING ASSEMBLY

(71) Applicant: SAFRAN AIRCRAFT ENGINES, Paris (FR)

(72) Inventors: Clement Roussille, Bordeaux (FR); Gael Evain, Bernay-Vilbert (FR); Adele Lyprendi, Albi (FR); Lucien Quennehen, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 294 days.

(21) Appl. No.: 15/576,157

(22) PCT Filed: May 18, 2016

(86) PCT No.: PCT/FR2016/051168
§ 371 (c)(1),
(2) Date: Nov. 21, 2017

(87) PCT Pub. No.: WO2016/189223
PCT Pub. Date: Dec. 1, 2016

(65) Prior Publication Data

US 2018/0156068 A1 Jun. 7, 2018

(30) Foreign Application Priority Data

May 22, 2015 (FR) ..... 15 54626

(51) Int. Cl.
*F01D 11/08* (2006.01)
*F01D 25/24* (2006.01)
*F01D 25/00* (2006.01)

(52) U.S. Cl.
CPC ..... *F01D 25/24* (2013.01); *F01D 11/08* (2013.01); *F01D 25/005* (2013.01);
(Continued)

(58) Field of Classification Search
CPC ..... F01D 11/08; F01D 11/025; F01D 25/246; F01D 11/16; F01D 11/18
See application file for complete search history.

(56) References Cited

U.S. PATENT DOCUMENTS 3,501,246 A * 3/1970 Hickey ..... F16J 15/442 415/174.2
6,733,235 B2 * 5/2004 Alford ..... F01D 11/08 415/173.1
(Continued)

FOREIGN PATENT DOCUMENTS

EP 1 350 927 A2 10/2003
GB 2480766 A 11/2011
(Continued)

OTHER PUBLICATIONS

International Search Report dated Aug. 1, 2016, in PCT/FR2016/051168 filed May 18, 2016.

*Primary Examiner* — J. Todd Newton
*Assistant Examiner* — Sabbir Hasan
(74) *Attorney, Agent, or Firm* — Oblon, McClelland, Maier & Neustadt, L.L.P.

(57) ABSTRACT

A turbine ring assembly includes both a plurality of ring sectors made of ceramic matrix composite material forming a turbine ring, and also a ring support structure. Each ring sector includes a portion forming an annular base with an inner face defining the inside space of the turbine ring and an outer face from which an attachment portion of the ring sector extends for attaching it to the ring support structure. The ring support structure includes two annular flanges between which the attachment portion of each ring sector is held. Each annular flange of the ring support structure presents at least one sloping portion bearing against the attachment portions of the ring sectors, the sloping portion, when observed in meridian section, forming a non-zero
(Continued)

angle relative to the radial direction and relative to the axial direction.

9 Claims, 8 Drawing Sheets

(52) U.S. Cl.
CPC ..... *F01D 25/246* (2013.01); *F05D 2230/642* (2013.01); *F05D 2240/11* (2013.01); *F05D 2300/6033* (2013.01)

(56) References Cited

U.S. PATENT DOCUMENTS

| | | | | |
|---|---|---|---|---|
| 7,771,159 | B2 * | 8/2010 | Johnson | F01D 11/008 415/135 |
| 2003/0185674 | A1 | 10/2003 | Alford et al. | |
| 2011/0293410 | A1 | 12/2011 | Marusko et al. | |
| 2014/0271145 | A1 | 9/2014 | Thomas et al. | |

FOREIGN PATENT DOCUMENTS

| | | | |
|---|---|---|---|
| RU | 2011 140 942 | A | 4/2013 |
| RU | 2522264 | C2 | 7/2014 |
| WO | WO 2013/115349 | A1 | 8/2013 |

* cited by examiner

TURBINE RING ASSEMBLY

BACKGROUND OF THE INVENTION

The invention relates to a turbine ring assembly comprising a plurality of ring sectors made of ceramic matrix composite material, together with a ring support structure.

When turbine ring assemblies are made entirely out of metal, it is necessary to cool all of the elements of the assembly, and in particular the turbine ring that is subjected to the hottest stream. Such cooling has a significant impact on the performance of the engine since the cooling stream used is taken from the main stream through the engine. In addition, using metal for the turbine ring limits potential for increasing temperature in the turbine, even though that would enable the performance of aeroengines to be improved.

In an attempt to solve such problems, proposals have been made to have recourse to turbine ring sectors that are made of ceramic matrix composite (CMC) material in order to avoid making use of a metal material.

CMC materials present good mechanical properties making them suitable for constituting structural elements, and advantageously they conserve these properties at high temperatures. Using CMC materials has advantageously made it possible to reduce the cooling stream that needs to be used in operation, and thus to improve the performance of engines. In addition, using CMC materials advantageously makes it possible to reduce the weight of engines and to reduce the effect of expansion when hot as encountered with metal parts.

Nevertheless, existing proposed solutions may involve assembling a CMC ring sector by using metal attachment portions of a ring support structure, these attachment portions being subjected to the hot stream. Consequently, the metal attachment portions are subjected to expansion when hot, and that can lead to the CMC ring sector being subjected to mechanical stress and being weakened.

Also known are Documents GB 2 480 766, EP 1 350 927, and US 2014/0271145, which disclose turbine ring assemblies.

There exists a need to improve existing turbine ring assemblies that use CMC material in order to reduce the magnitude of the mechanical stresses to which the CMC ring sectors are subjected in operation.

OBJECT AND SUMMARY OF THE INVENTION

To this end, in a first aspect, the invention provides a turbine ring assembly comprising both a plurality of ring sectors made of ceramic matrix composite material forming a turbine ring, and also a ring support structure, each ring sector having a portion forming an annular base with an inner face defining the inside space of the turbine ring and an outer face from which an attachment portion of the ring sector extends for attaching it to the ring support structure, the ring support structure comprising two annular flanges between which the attachment portion of each ring sector is held, each annular flange of the ring support structure presenting at least one sloping portion bearing against the attachment portions of the ring sectors, said sloping portion, when observed in meridian section, forming a non-zero angle relative to the radial direction and relative to the axial direction.

The radial direction corresponds to the direction along a radius of the turbine ring (a straight line connecting the center of the turbine ring to its periphery). The axial direction corresponds to the direction of the axis of revolution of the turbine ring and also to the flow direction of the gas stream in the gas flow passage.

Using such sloping portions on the annular flanges of the ring support structure serves advantageously to compensate for expansion differences between the annular flanges and the attachment portions of the ring sector, thereby reducing the mechanical stresses to which the ring sectors are subjected in operation.

Preferably, at least one of the flanges of the ring support structure is elastically deformable. This makes it possible advantageously to compensate even better for differential expansion between the attachment portions of the CMC ring sectors and the flanges of the metal ring support structure without significantly increasing the stress that is exerted when "cold" by the flanges on the attachment portions of the ring sectors. In particular, both flanges of the ring support structure are elastically deformable or else only one of the two flanges of the ring support structure is elastically deformable.

In an embodiment, each of the annular flanges of the ring support structure may present first and second sloping portions bearing against the attachment portions of the ring sectors, each of said first and second sloping portions, when observed in meridian section, forming a non-zero angle relative to the radial direction and to the axial direction. In particular, the first sloping portion may bear against the upper halves of the attachment portions of the ring sectors, and the second sloping portion may bear against the lower halves of the attachment portions of the ring sectors.

The upper half of an attachment portion of a ring sector corresponds to the fraction of said attachment portion that extends radially between the zone halfway along the attachment portion and the end of the attachment portion situated beside the ring support structure. The lower half of an attachment portion of a ring sector corresponds to the fraction of the attachment portion extending radially between the zone halfway along the attachment portion and the end of the attachment portion situated beside the annular base.

In an embodiment, the ring support structure may present axial portions that bear against the attachment portions of the ring sectors, each axial portion possibly extending parallel to the axial direction, these axial portions possibly being formed by the annular flanges or by a plurality of fitted elements engaged without clearance when cold through the annular flanges. In particular, the attachment portions of the ring sectors may be held to the ring support structure via such axial portions.

In an embodiment, the annular flanges of the ring support structure may grip the attachment portions of the ring sectors over at least half of the length of said attachment portions.

In an embodiment, the annular flanges of the ring support structure may grip the attachment portions of the ring sectors at least at the radially outer ends of said attachment portions. The radially outer end of an attachment portion corresponds to the end of the attachment portion that is situated remote from the flow passage for the gas stream. In particular, the annular flanges of the ring support structure may grip the attachment portions of the ring sectors solely via the upper halves of said attachment portions.

In an embodiment, the attachment portion of each ring sector may be in the form of tabs extending radially. In particular, the radially outer ends of the ring sector tabs need not be in contact and the tabs of the ring sectors may define between them an internal ventilation volume for each of the ring sectors.

In an embodiment, the attachment portion of each of the ring sectors is in the form of a bulb.

In an embodiment, the ring sectors are of a section that is substantially Ω-shaped or substantially π-shaped.

The present invention also provides a turbine engine including a turbine ring assembly as described above.

The turbine ring assembly may form part of gas turbine of an aeroengine, or in a variant it may form part of an industrial turbine.

BRIEF DESCRIPTION OF THE DRAWINGS

Other characteristics and advantages of the invention appear from the following description of particular embodiments of the invention, given as non-limiting examples, and with reference to the accompanying drawings, in which.

DETAILED DESCRIPTION OF EMBODIMENTS

Below, the terms "upstream" and "downstream" are used with reference to the flow direction of the gas stream through the turbine (see arrow F in FIG. 1, for example).

Figure 1:
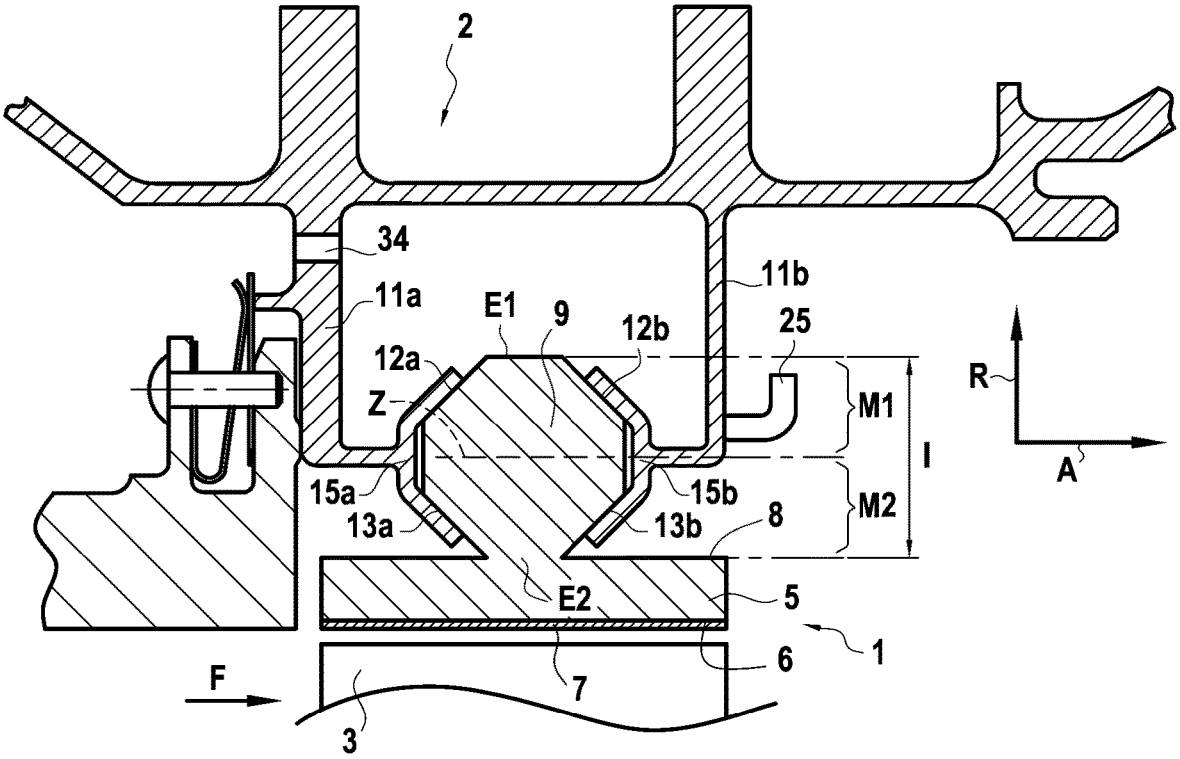
FIG. 1 is a meridian section view showing an embodiment of a turbine ring assembly of the invention.

FIG. 1 shows a turbine ring sector 1 and a casing 2 made of metal material constituting a ring support structure. The ring support structure 2 is made of a metal material such as the alloy Waspaloy® or the alloy Inconel® 718.

The ring sector assembly 1 is mounted on the casing 2 so as to form a turbine ring that surrounds a set of rotary blades 3. The arrow F shows the flow direction of the gas stream through the turbine. The ring sectors 1 are single pieces made of CMC. The use of a CMC material for making ring sectors 1 is advantageous in order to reduce the ventilation requirements of the ring. In the example shown, the ring sectors 1 are substantially Ω-shaped, with an annular base 5 having its radially inner face 6 coated in a layer 7 of abradable material to define the flow passage for the gas stream through the turbine. Furthermore, the annular base 5 has a radially outer face 8 from which there extends an attachment portion 9. In the example shown, the attachment portion 9 is in the form of a solid bulb, but it would not go beyond the ambit of the invention for the attachment portion to be in the form of a hollow bulb or for it to be in some other form as described in detail below. Sealing is provided between sectors by sealing tongues (not shown) received in grooves that face one another in the facing edges of two adjacent ring sectors.

Each above-described ring sector 1 is made of CMC by forming a fiber preform of shape close to the shape of the ring sector and by densifying the ring sector with a ceramic matrix. In order to make the fiber preform, it is possible to use yarns made of ceramic fiber, e.g. yarns made of SiC fibers such as those sold by the Japanese supplier Nippon Carbon under the name "Nicalon", or yarns made of carbon fibers. The fiber preform is advantageously made by three-dimensional weaving, or by multilayer weaving. The weaving may be of the interlock type. Other three-dimensional or multilayer weaves may be used, such as for example multi-plain or multi-satin weaves. Reference may be made for this purpose to Document WO 2006/136755. After weaving, the blank may be shaped in order to obtain a ring sector preform that is subsequently consolidated and densified by a ceramic matrix, which densification may be performed in particular by chemical vapor infiltration (CVI), as is well known. A detailed example of fabricating CMC ring sectors is described in particular in Document US 2012/0027572.

The casing 2 has two annular radial flanges 11*a* and 11*b* made of metal material that extend radially towards a flow passage for the gas stream. The annular flanges 11*a* and 11*b* of the casing 2 grip the attachment portions 9 of the ring sectors 1 axially. Thus, as shown in FIG. 1, the attachment portions 9 of the ring sectors 1 are held between the annular flanges 11*a* and 11*b*, the attachment portions 9 being received between the annular flanges 11*a* and 11*b*. Furthermore, in conventional manner, ventilation orifices 34 formed in the flange 11*a* serves to bring air for cooling the outside of the turbine ring 1.

Figure 2:
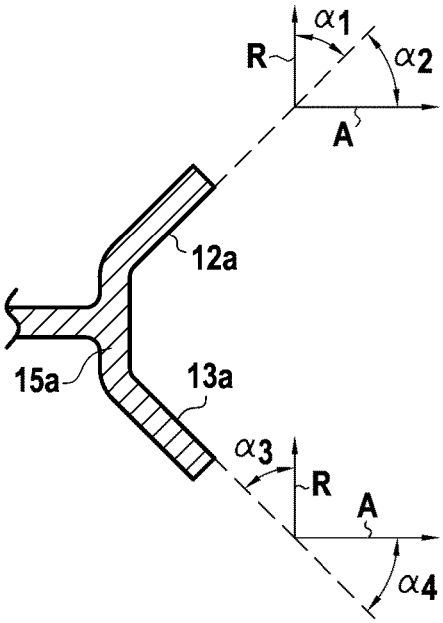
FIG. 2 shows a detail of FIG. 1.

Each of the annular flanges 11*a* and 11*b* present two sloping portions bearing against the attachment portions 9 of the ring sectors 1 in order to hold them. The sloping portions of the annular flanges 11*a* and 11*b* are in contact with the attachment portions 9 of the ring sectors 1. The upstream annular flange 11*a* presents a first sloping portion 12*a* and a second sloping portion 13*a*. The flange 11*a* also presents a third portion 15*a* that extends in the radial direction R and that is situated between the first and second sloping portions 12*a* and 13*a*. The downstream annular flange 11*b* also presents a first sloping portion 12*b* and a second sloping portion 13*b*. The flange 11*b* also presents a third portion 15*b* extending in the radial direction R and situated between the first and second sloping portions 12*b* and 13*b*. When observed in meridian section, and as shown in FIGS. 1 and 2, the first sloping portion 12*a* of the upstream annular flange 11*a* forms a non-zero angle $\alpha_1$ with the radial direction R and forms a non-zero angle $\alpha_2$ with the axial direction A. Likewise, when observed in meridian section, the second sloping portion 13*a* of the upstream annular flange 11*a* forms a non-zero angle $\alpha_3$ with the radial direction R and forms a non-zero angle $\alpha_4$ with the axial direction A. The same applies to the first and second sloping portions 12*b* and 13*b* of the downstream annular flange 11*b*. The first and second sloping portions 12*a* and 13*a* extend in non-parallel directions (they form a non-zero angle relative to each other). The same applies for the first and second sloping portions 12*b* and 13*b*. As shown, the sloping portions of the annular flanges 11*a* and 11*b* extend so as to form a non-zero angle with the radial direction R and a non-zero angle with the axial direction A. In the example shown, each of the sloping portions of the annular flanges 11*a* and 11*b* extends in a straight line. In the example shown, each of the sloping portions 12*a*, 12*b*, 13*a*, and 13*b* is elongate in shape. When observed in meridian section, some or all of the sloping portions of the annular flanges 11*a* and 11*b* may form an angle lying in the range 30° to 60° with the radial direction. For each of the annular flanges 11*a* and 11*b*, the angle formed between its first sloping portion and the radial direction may optionally be equal to the angle formed between its second sloping portion and the radial direction, when the first and second sloping portions are observed in meridian section.

In the example shown, the annular flanges 11*a* and 11*b* grip the attachment portions 9 of the ring sectors over more than half of the length l of said attachment portions 9, in particular over at least 75% of this length. The length l is measured in the radial direction R.

In the example shown in FIG. 1, each of the first sloping portions 12*a* and 12*b*, when observed in meridian section, bears against the upper halves $M_1$ of the attachment portions 9, while each of the second sloping portions 13*a* and 13*b*, when observed in meridian section, bears against the lower halves $M_2$ of the attachment portions 9. The upper half $M_1$ corresponds to the fraction of the attachment portion 9 that extends radially between the zone Z halfway along the attachment portion 9 and the end $E_1$ of the attachment portion that is situated beside the ring support structure 2 (the radially outer end). The lower half $M_2$ corresponds to the fraction of the attachment portion 9 that extends radially between the zone Z halfway along the attachment portion 9 and the end $E_2$ of the attachment portion situated beside the annular base 5 (radially inner end). The sloping portions of the annular flanges 11*a* and 11*b* define two hooks between which the attachment portions 9 of the ring sectors 1 are gripped axially. In the example shown, each of these hooks presents substantially a C-shape.

Nevertheless, the invention is not limited to annular flanges each presenting such first and second sloping portions. Specifically, the description below covers situations in which each of the annular flanges presents a single sloping portion bearing against the attachment portions of the ring sectors.

As mentioned above, using sloping portions serves advantageously to compensate for expansion differences between the annular flanges 11*a* and 11*b* relative to the ring sectors 1, and also to reduce the mechanical stresses to which the ring sector 1 are subjected in operation.

In the embodiment of FIGS. 1 to 5, at least one of the annular flanges (flange 11*b* in FIG. 1) is provided, as shown, on its outside face with a hook 25 having a function that is described in detail below.

In the example shown in FIG. 1, the ring sectors are held to the ring support structure 2 solely by the annular flanges 11*a* and 11*b* (there are no additional fittings such as pegs passing through the attachment portions 9 of the ring sectors). As described in detail below, certain embodiments of the invention can make use of fittings to contribute to holding the ring sectors on the ring support structure.

Figure 3:
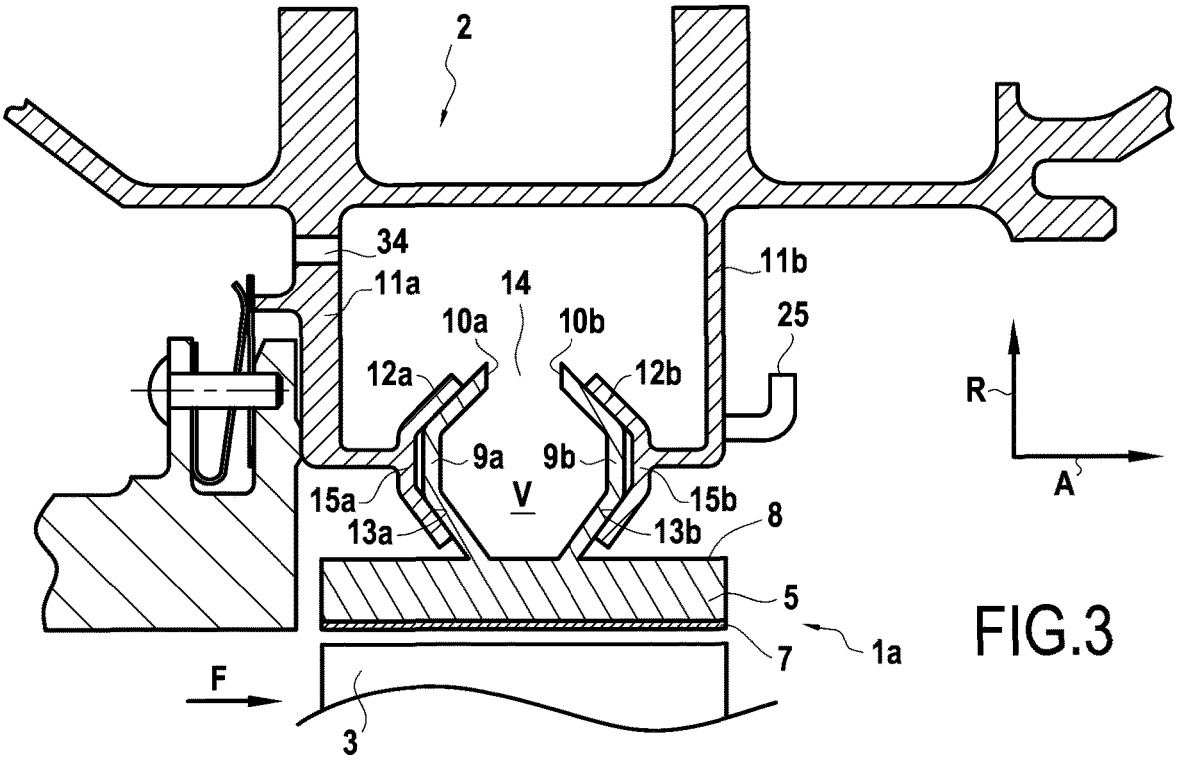
FIGS. 3 to 6 are meridian section views showing variant embodiments of turbine ring assemblies of the invention.

FIG. 3 shows a variant embodiment of the turbine ring assembly of the invention. In this example, the attachment portions of the ring sectors 1*a* are in the form of tabs 9*a* and 9*b* that extend radially from the outer face 8 of the annular base 5. In this example, the radially outer ends 10*a* and 10*b* of the tabs 9*a* and 9*b* of the ring sectors 1*a* do not come into contact. The radially outer end of a tab of a ring sector corresponds to the end of said tab that is situated remote from the flow passage for the gas stream. In the example shown in FIG. 3, the radially outer ends 10*a* and 10*b* are spaced apart along the axial direction A. The tabs 9*a* and 9*b* of the ring sectors define between them an internal ventilation volume V for each of the ring sectors 1*a*. It is thus possible to ventilate the ring sectors 1*a* by sending cooling air towards their annular bases 5 via the ventilation orifice 14 defined between the tabs 9*a* and 9*b*.

The ring sectors 1*a* of FIG. 3 present substantially an Ω-shape that is open at its end situated beside the ring support structure 2.

The fiber preform that is to form the ring sector 1*a* of the type shown in FIG. 3 may be made by three-dimensional weaving, or multilayer weaving, with zones of non-interlinking being provided to enable the preform portions corresponding to the tabs 9*a* and 9*b* to be moved away from the preform portion corresponding to the base 5. In a variant, the preform portions corresponding to the tabs may be made by weaving layers of yarns passing through the preform portion corresponding to the base 5.

Figure 4:
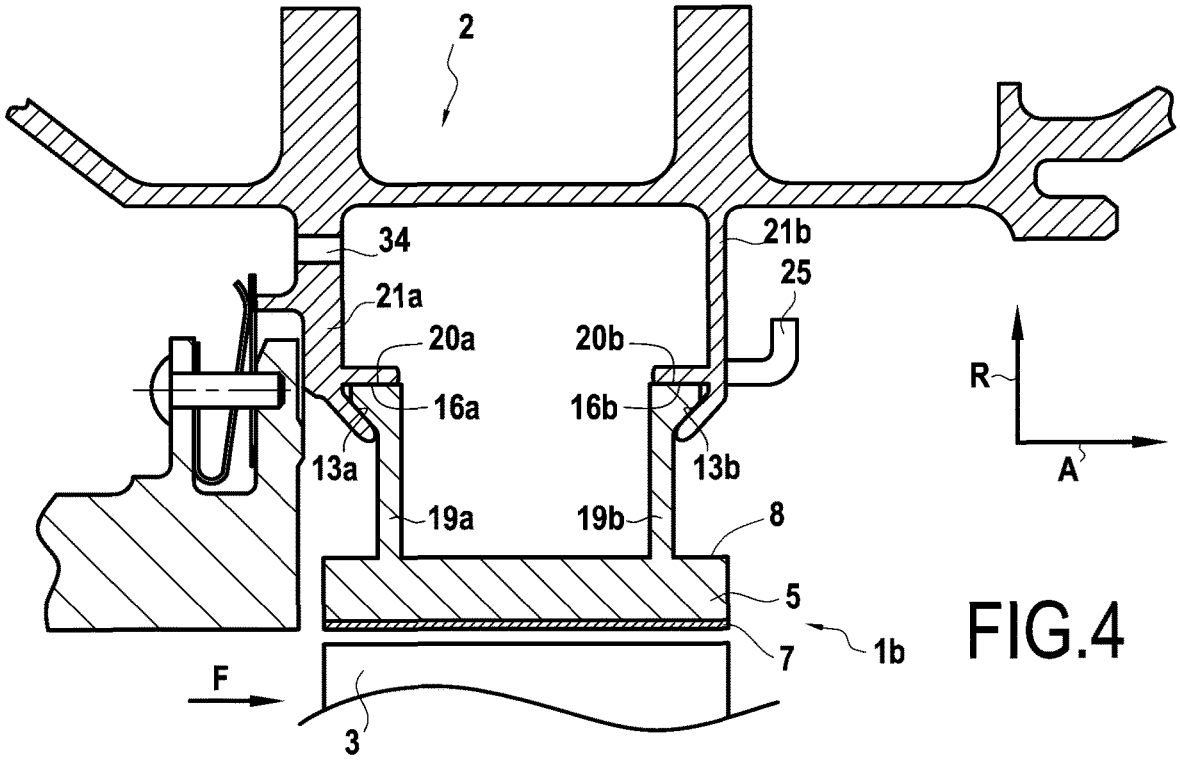

FIG. 4 shows a variant embodiment in which the ring sectors 1*b* are held to the ring support structure 2 via annular flanges 21*a* and 21*b*, each presenting, as shown, an axial portion 16*a* or 16*b* extending parallel to the axial direction A. In addition, each of the annular flanges 21*a* and 21*b* presents a single sloping portion 13*a* or 13*b* bearing against the tabs 19*a* or 19*b* of the ring sectors 1*b* and forming a non-zero angle relative to the radial direction R and relative to the axial direction A. The axial portions 16*a* and 16*b* bear against the tabs 19*a* and 19*b* of the ring sectors. The tabs 19*a* and 19*b* forming the attachment portions of the ring sectors 1*b* are held to the ring support structure 2 via the axial portions 16*a* and 16*b*. The axial portions 16*a* and 16*b* formed by the annular flanges prevent the ring sectors 1*b* moving outwards in the radial direction R. The annular flanges 21*a* and 21*b* grip the tabs 19*a* and 19*b* of the ring sectors 1*b* axially at their radially outer ends 20*a* and 20*b*. In the example shown, the sloping portion and the axial portion of each of the annular flanges 21*a* and 21*b* together form a hook bearing against a tab 19*a* or 19*b* of the ring sectors 1*b*. The tabs 19*a* and 19*b* of the ring sectors 1*b* are griped axially between the two hooks formed by the annular flanges 21*a* and 21*b*. In the example shown in FIG. 4, the ring sectors 1*b* present a section that is substantially π-shaped.

Figure 5:
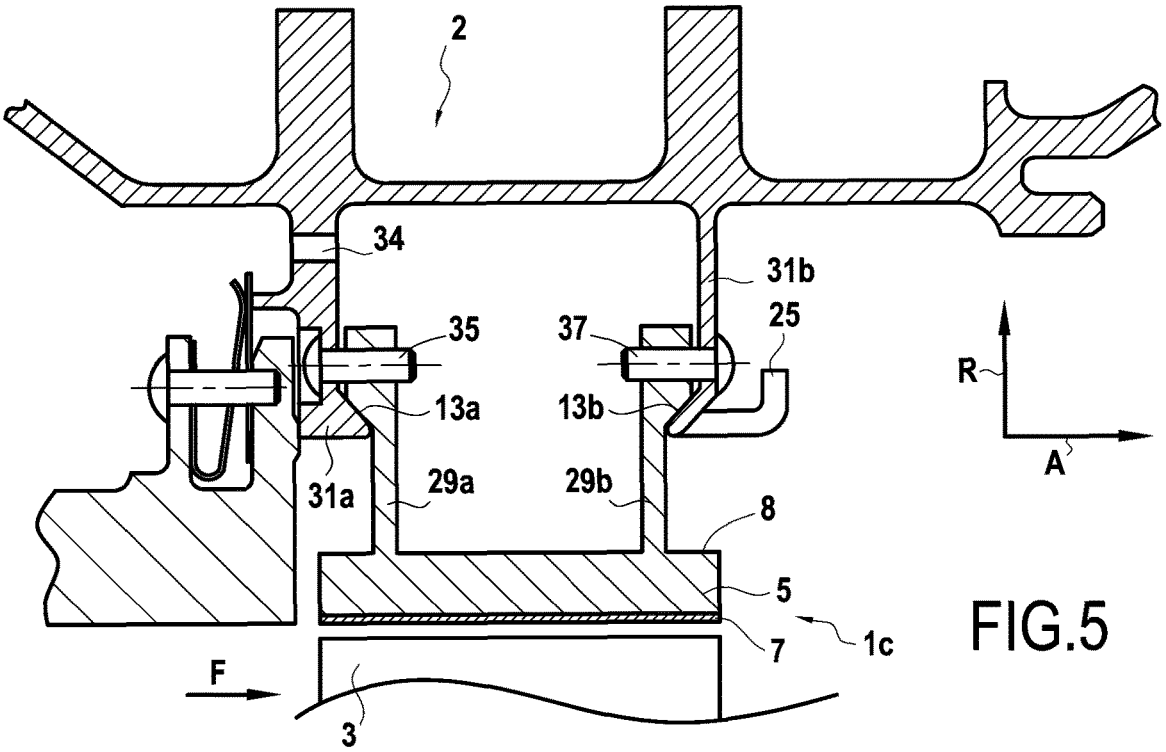

The embodiments that are described with reference to FIGS. 5 and 6 relate to the situation in which fitted elements are present through the attachment portions of the ring sectors in order to hold them. As explained above, the presence of such fitted elements is optional in the context of the present invention. FIG. 5 shows a variant embodiment in which the ring sectors 1*c* are held by blocking pegs 35 and 37. More precisely, and as shown in FIG. 5, the pegs 35 are engaged both in the upstream annular radial flange 31*a* of the ring support structure 2 and in the upstream tabs 29*a* of the ring sectors 1*c*. For this purpose, each peg 35 passes through a respective orifice formed in the upstream annular radial flange 31*a* and an orifice formed in each upstream tab 29*a*, the orifices in the flange 31*a* and in the tab 29*a* being put into alignment when mounting the ring sectors 1*c* on the ring support structure 2. Likewise, pegs 37 are engaged both through the downstream annular radial flange 31*b* of the ring support structure 2 and through the downstream tabs 29*b* of the ring sectors 1*c*. For this purpose, each peg 37 passes through a respective orifice formed in the downstream annular radial flange 31*b* and an orifice formed in each downstream tab 29*b*, the orifices in the flange 31*b* and the tabs 29*b* being put into alignment while mounting the ring sectors 1*c* on the ring support structure 2. The pegs 35 and 37 are engaged without clearance when cold through the flanges 31*a* and 31*b* and the tabs 29*a* and 29*b*. The pegs 35 and 37 serve to prevent the ring sectors 1*c* from turning. The pegs 35 and 37 prevent the ring sectors 1*c* moving towards the inside or towards the outside in the radial direction R. Each annular flange 31*a* and 31*b* also presents a single sloping portion 13*a* or 13*b* serving to reduce the stress applied to the ring sectors 1*c* when the annular flanges 31*a* and 31*b* expand in operation.

Figure 6:
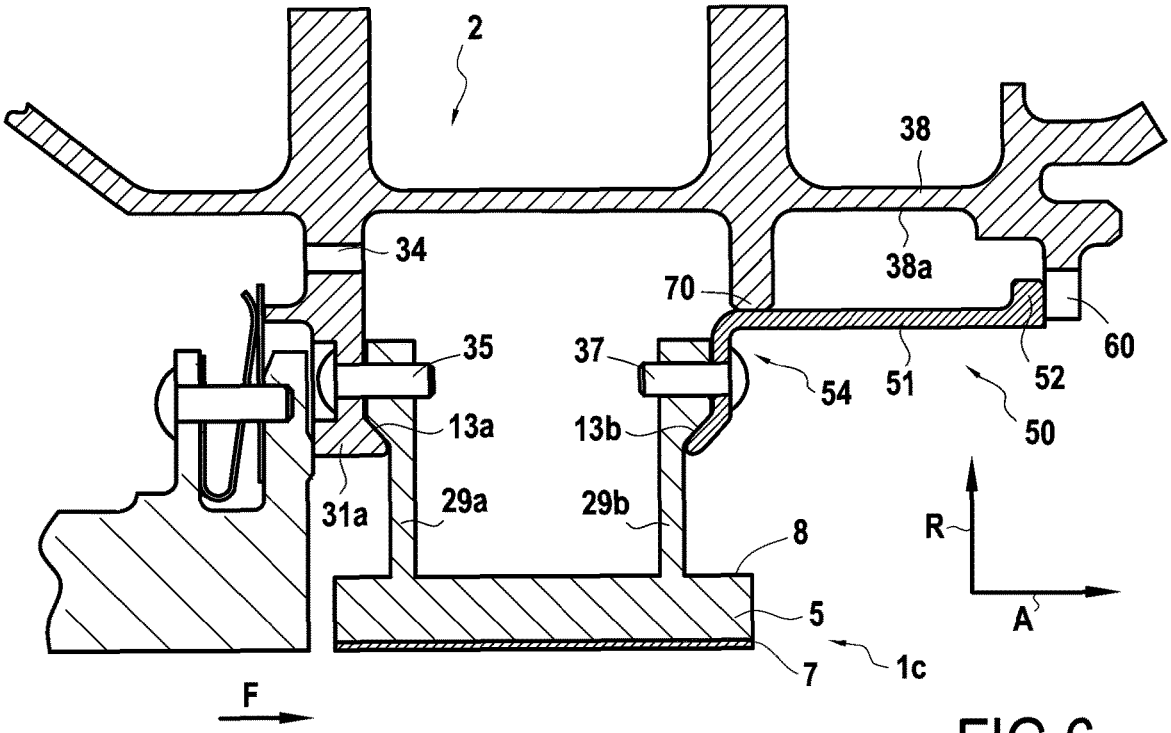

FIG. 6 shows a variant embodiment in which each ring sector 1*c* has a section that is substantially π-shaped with an annular base 5 having its inner face coated in a layer 7 of abradable material defining the flow passage for the gas stream through the turbine. Upstream and downstream tabs 29*a* and 29*b* extend in the radial direction R from the outer face of the annular base 5.

Figure 7:
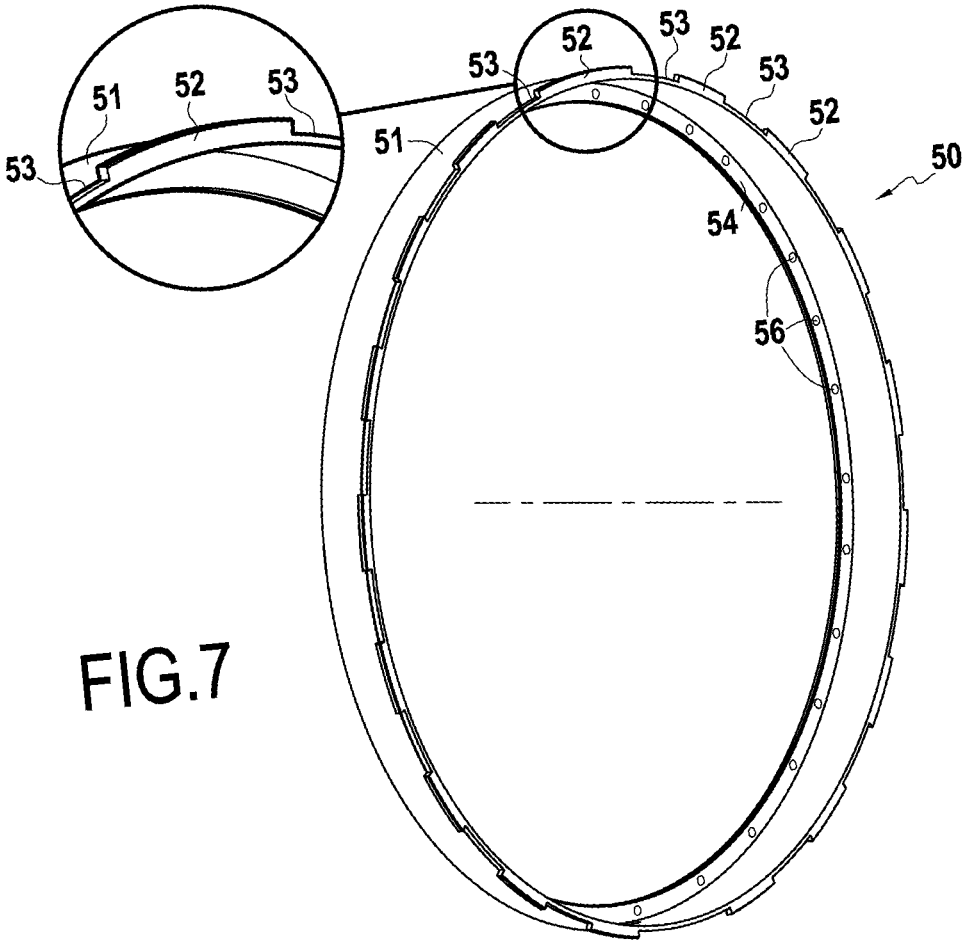
FIG. 7 shows the retention band used in the embodiment of FIG. 6.
Figure 13:
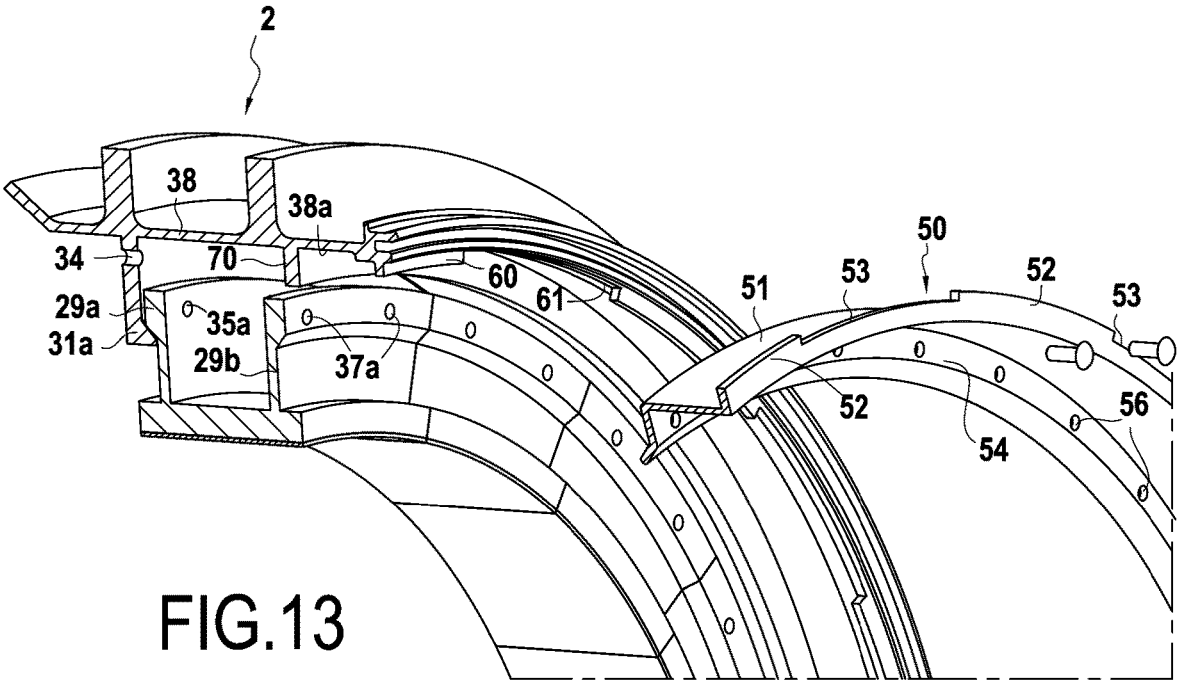

In this embodiment, the ring support structure 2 is made up of two portions, namely a first portion corresponding to an upstream annular radial flange 31*a* that is presently formed internally with a turbine casing, and a second portion corresponding to an annular retention band 50 mounted on the turbine casing. The upstream annular radial flange 31*a* includes a sloping portion 13*a* as described above bearing against the upstream tabs 29*a* of the ring sectors 1*c*. On its downstream side, the band 50 comprises an annular web 57 that forms a downstream annular radial flange 54 comprising a sloping portion 13*b* as described above bearing against the downstream tabs 29*b* of the ring sectors 1*c*. The band 50 comprises an annular body 51 extending axially and comprising, on its upstream side, the annular web 57, and on its downstream side, a first series of teeth 52 that are distributed circumferentially on the band 50 and that are spaced apart from one another by first engagement passages 53 (FIG. 7). On its downstream side, the turbine casing includes a second series of teeth 60 extending radially from the inside surface 38*a* of the shroud 38 of the turbine casing. The teeth 60 are distributed circumferentially on the inside surface 38*a* of the shroud 38 and they are spaced apart from one another by second engagement passages 61 (FIG. 13). The teeth 52 and 60 co-operate with one another to form a circumferential twist-lock law coupling.

The tabs 29*a* and 29*b* of each ring sector 1*c* are mounted with prestress between the annular flanges 31*a* and 54 so that, at least when "cold", i.e. at an ambient temperature of about 25° C., the flanges exert a stress on the tabs 29*a* and 29*b*. Furthermore, as in the embodiment of FIG. 5, the ring sectors 1*c* are also held by blocking pegs 35 and 37.

At least one of the flanges of the ring support structure is elastically deformable, thereby serving even better to compensate differential expansion between the tabs of the ring sectors made of CMC and the flanges of the ring support structure made of metal, without significantly increasing the stress exerted when "cold" by the flanges on the tabs of the ring sectors.

Furthermore, the turbine ring assembly is provided with upstream to downstream sealing by an annular projection 70 extending radially from the inside surface 38*a* of the shroud 38 of the turbine casing and having its free end in contact with the surface of the body 51 of the ring 50.

There follows a description of two mounting methods suitable for mounting the ring sectors on the ring support structure.

Figure 8:
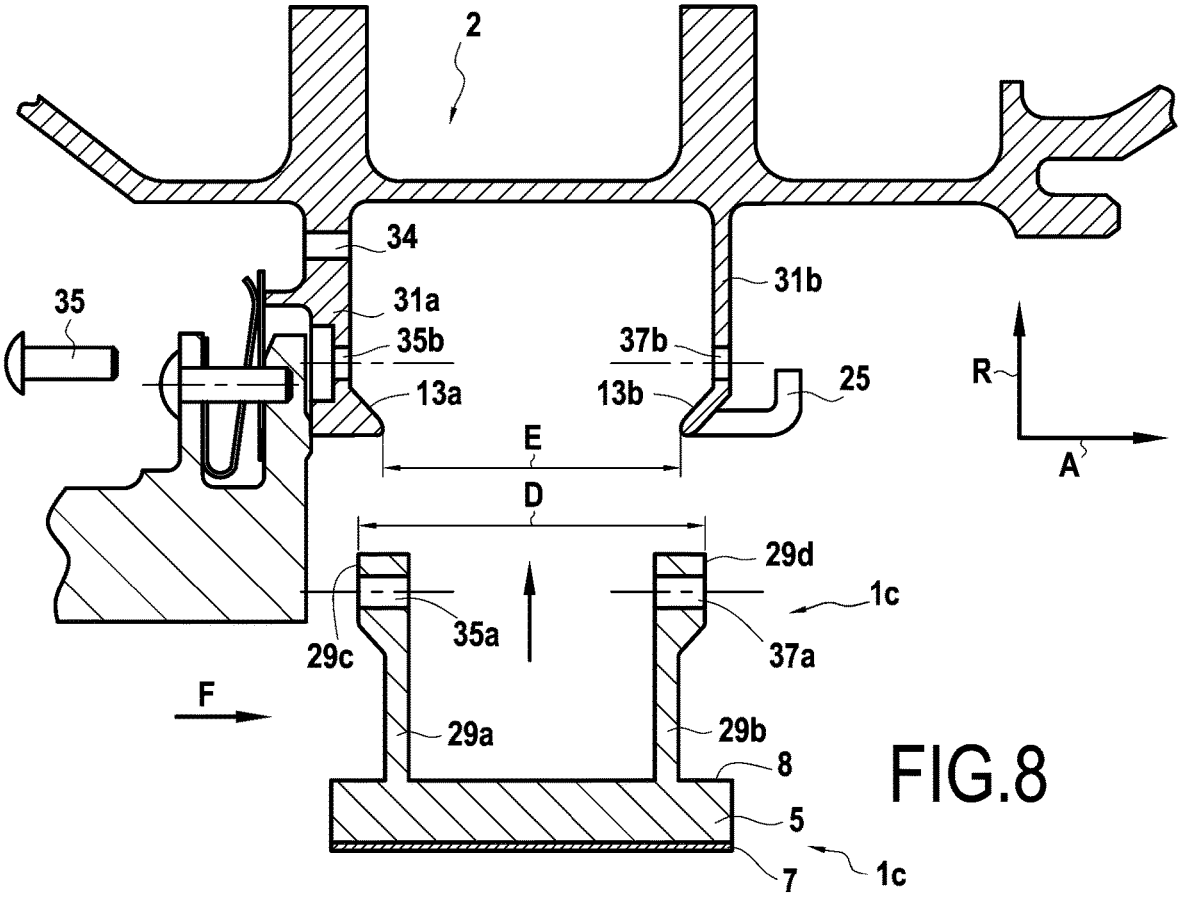
FIGS. 8 to 10 show how ring sectors are mounted in the embodiment of FIG. 5.
Figure 9:
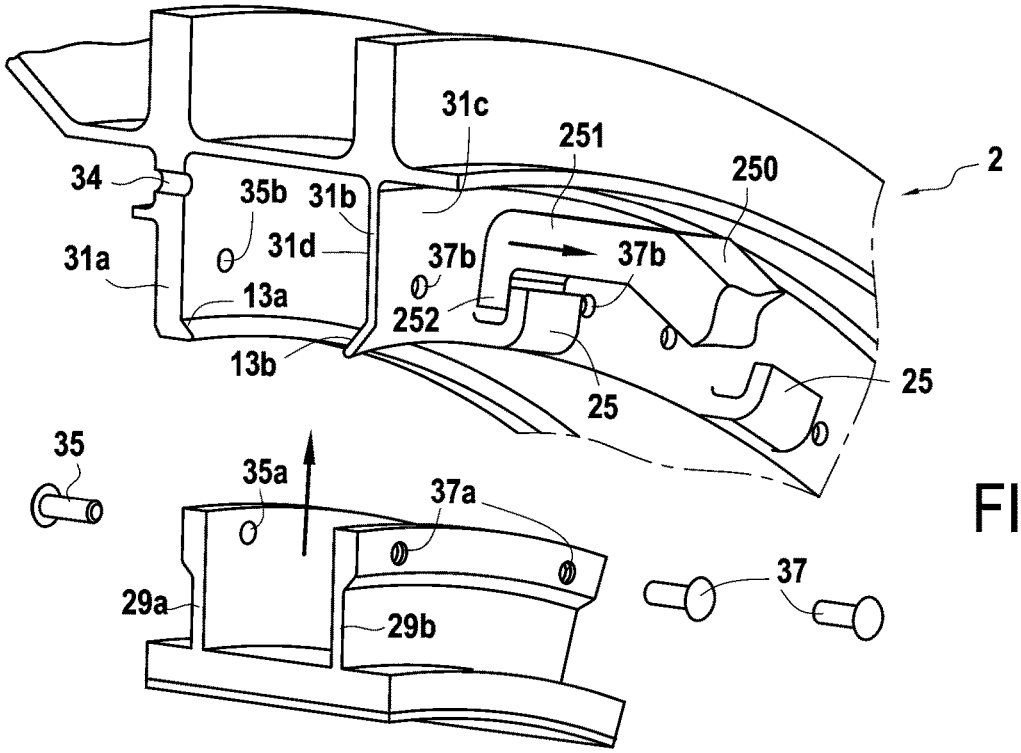
Figure 10:
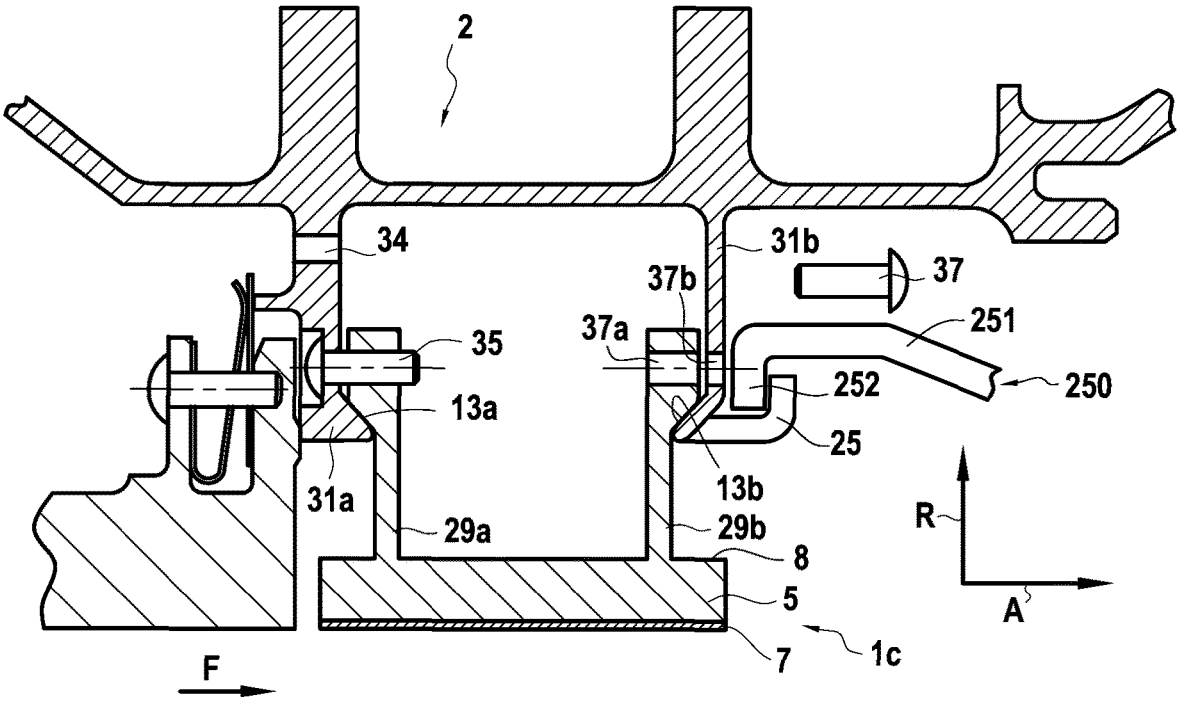

FIGS. 8 to 10 are described to illustrate mounting the ring sectors for the embodiment of FIG. 5. As shown in FIG. 8, the spacing E between the upstream annular radial flange 31*a* and the downstream annular radial flange 31*b* while at "rest", i.e. when no ring sector is mounted between the flanges, is smaller than the distance D present between the outside faces 29*c* and 29*d* of the upstream and downstream tabs 29*a* and 29*b* of the ring sectors. The spacing E is measured between the ends of the sloping portions 13*a* and 13*b* of the annular flanges 31*a* and 31*b*.

The ring support structure has at least one annular flange that is elastically deformable in the axial direction A of the ring. In the present example, the downstream annular radial flange 31*b* is elastically deformable. While mounting a ring sector 1*c*, the downstream annular radial flange 31*b* is pulled in the axial direction A, as shown in FIGS. 9 and 10 so as to increase the spacing between the flanges 31*a* and 31*b* and allow the tabs 29*a* and 29*b* to be inserted between the flanges 31*a* and 31*b* without risk of damage. Once the tabs 29*a* and 29*b* of a ring sector 1*c* are inserted between the flanges 31*a* and 31*b* and positioned so as to align the orifices 35*a* and 35*b* and also the orifices 37*a* and 37*b*, the flange 31*b* is released in order to hold the ring sector. In order to make it easier to pull the downstream annular radial flange 31*b*, it includes a plurality of hooks 25 that are distributed over its face 31*c*, i.e. its face opposite from the face 31*d* of the flange 31*b* that faces the downstream tabs 29*b* of the ring sectors 1*c*. In this example, the traction exerted on the elastically deformable flange 31*b* in the axial direction A is delivered by means of a tool 250 having at least one arm 251 with a hook 252 at its end that is engaged in the hook 25 present on the outside face 31*c* of the flange 31*b*.

The number of hooks 25 distributed over the face 31*c* of the flange 31*b* is defined as a function of the number of traction points that it is desired to have on the flange 31*b*. This number depends mainly on the elastic nature of the flange. Naturally, it is possible to envisage other shapes and arrangements of means that enable traction to be exerted on the flanges of the ring support structure in the axial direction A.

Once the ring sector 1*c* is inserted and in position between the flanges 31*a* and 31*b*, pegs 35 are engaged in the aligned orifices 35*b* and 35*a* formed respectively in the upstream annular radial flange 31*a* and in the upstream tab 29*a*, and pegs 37 are engaged in the aligned orifices 37*b* and 37*a* arranged respectively in the downstream annular radial flange 31*b* and in the downstream tab 29*b*. Each tab 29*a* or 29*b* of the ring sector may include one or more orifices for passing a blocking peg.

An analogous method may be used for mounting ring sectors for the embodiments shown in FIGS. 1, 3, and 4, with the exception that no blocking pegs are then used.

Figure 11:
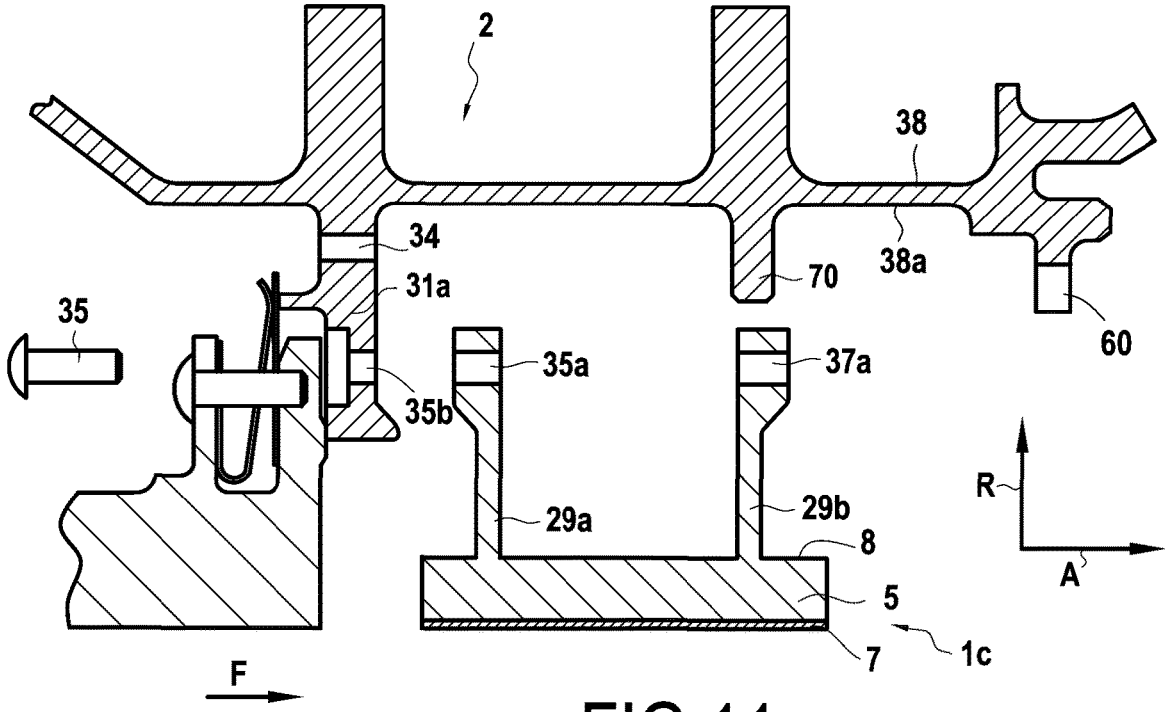
FIGS. 11 to 15 show how ring sectors are mounted in the embodiment of FIG. 6.
Figure 12:
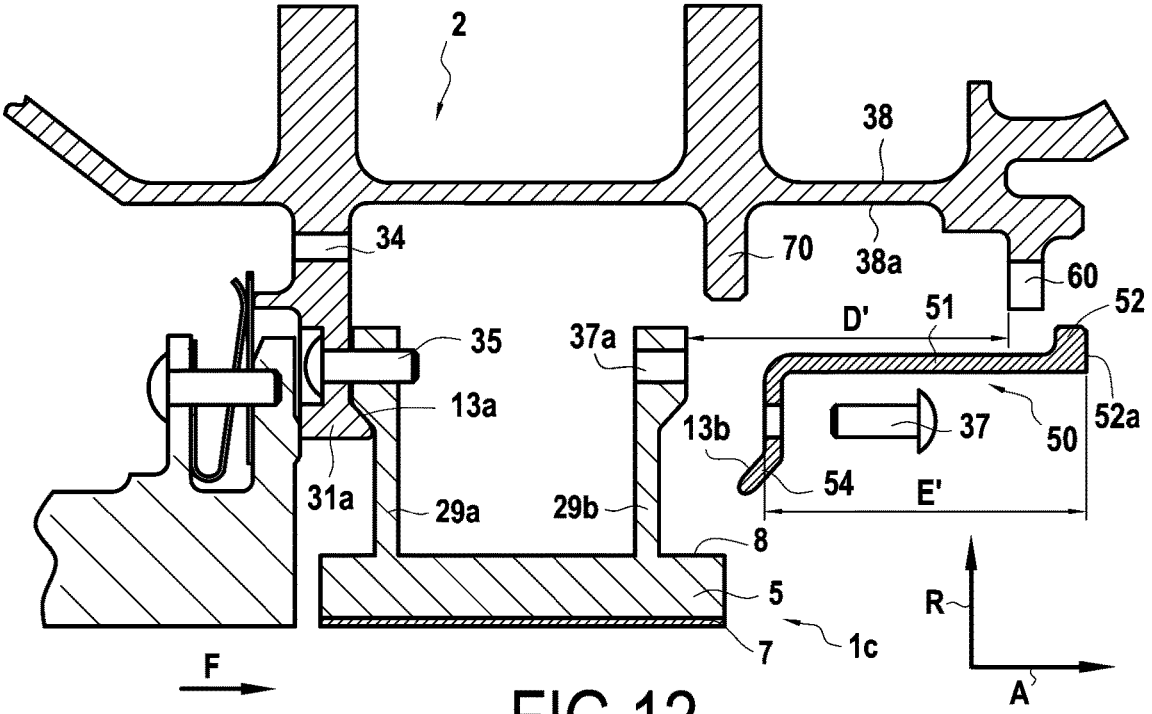

There follows a description of mounting ring sectors 1*c* for the embodiment of FIG. 6. As shown in FIG. 11, the ring sectors 1*c* are initially fastened via their upstream tabs 29*a* to the upstream annular radial flange 31*a* of the ring support structure 2 by pegs 35 that are engaged in the aligned orifices 35*b* and 35*a* formed respectively in the upstream annular radial flange 31*a* and in the upstream tab 29*a*.

Once all of the ring sectors 1*c* have been fastened in this way to the upstream annular radial flange 31*a*, the annular retention band 50 is assembled by twist-lock jaw coupling between the turbine casing and the downstream tabs 29*b* of the ring sectors. In the presently-described embodiment, the spacing E' between the downstream annular radial flange 54 formed by the annular web 57 of the band 50 and the outer surfaces 52*a* of the teeth 52 of said band is greater than the distance D' present between the outer faces 29*d* of the downstream tabs 29*b* of the ring sectors and the inner faces 60*a* of the teeth 60 present on the turbine casing. By defining a spacing E' between the downstream annular radial flange and the outer surfaces of the teeth of the band that is greater than the distance D' between the outer faces of the downstream tabs of the ring sectors and the inner faces of the teeth present on the turbine casing, it is possible to mount the ring sectors with prestress between the flanges of the ring support structure.

The ring support structure includes at least one annular flange that is elastically deformable in the axial direction A of the ring. In the presently-described example, it is the downstream annular radial flange 54 present on the band 50 that is elastically deformable. Specifically, the annular web 57 forming the downstream annular radial flange 54 of the ring support structure 2 is of small thickness compared with the upstream annular radial flange 31*a*, thereby giving it a certain amount of resilience.

Figure 14:
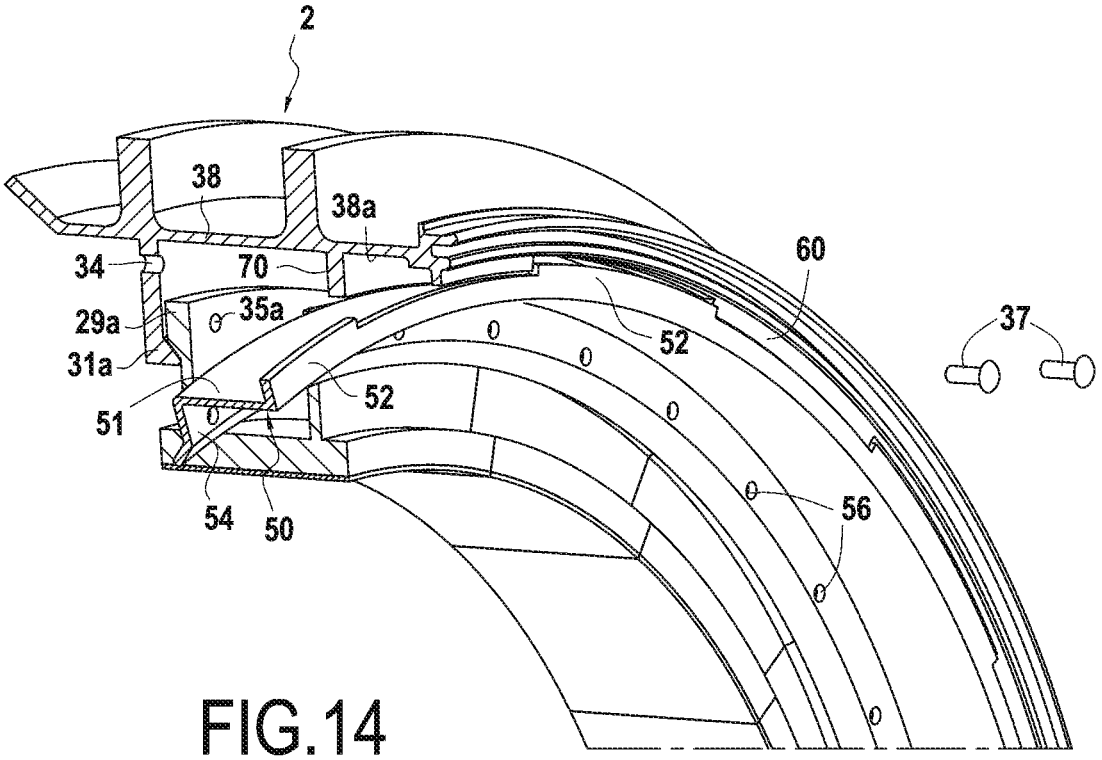
Figure 15:
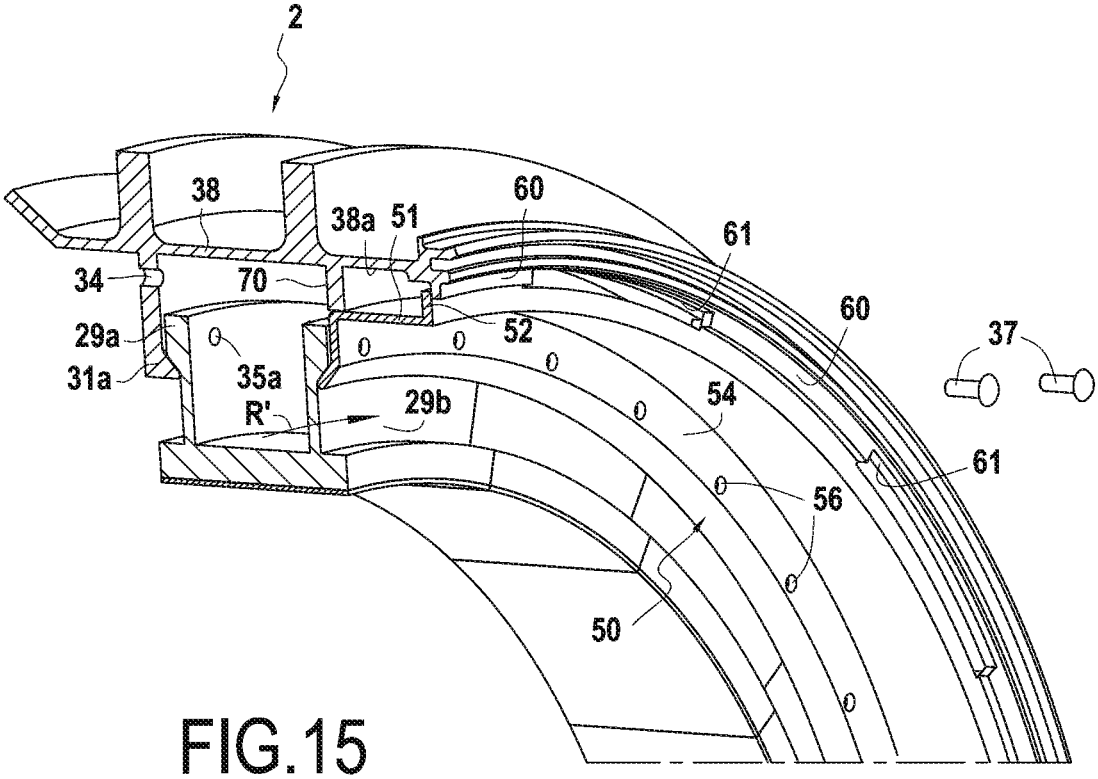

As shown in FIGS. 14 and 15, the band 50 is mounted on the turbine casing by placing the teeth 52 present on the band 50 in register with the engagement passages 61 formed on the turbine casing, the teeth 60 present on said turbine casing likewise being placed in register with the engagement passages 53 formed between the teeth 52 on the band 50. Since the spacing E' is greater than the distance D', it is necessary to apply an axial force on the band 50 in the direction shown in FIG. 14 in order to engage the teeth 52 beyond the teeth 60 and enable the band to be turned R' through an angle corresponding substantially to the width of the teeth 60 and 52. After being turned in this way, the band 50 is released so that it is then held with axial stress between the downstream tabs 29*b* of the ring sectors and the inner surfaces 60*a* of the teeth 60 of the turbine casing.

Once the band has been put into place in this way, the pegs 37 are engaged in the aligned orifice 56 and 37*a* formed respectively in the downstream annular radial flange 54 and in the downstream tabs 29*b*. Each tab 29*a* or 29*b* of the ring sector may include one or more orifices for passing a blocking peg.

The term "lying in the range . . . to . . . " should be understood as including the bounds.

The invention claimed is:

1. A turbine ring assembly comprising:

a plurality of ring sectors made of ceramic matrix composite material forming a turbine ring; and a ring support structure, wherein each of the plurality of ring sectors includes a portion forming an annular base with an inner face defining an inside space of the turbine ring and an outer face from which an attachment portion of the each of the plurality of ring sectors extends for attaching the each of the plurality of ring sectors to the ring support structure, wherein the ring support structure comprises first and second annular flanges between which the attachment portion of each of the plurality of ring sectors is held, each of the first and second annular flanges of the ring support structure presenting first and second sloping portions bearing against the attachment portion of each of the plurality of ring sectors and extending in non-parallel directions from each other, wherein each of said first and second sloping portions, when observed in meridian section, forms a non-zero angle relative to a radial direction and relative to an axial direction, and wherein each of the plurality of ring sectors is of a section that is Ω-shaped having an end situated beside the ring support structure that is open or not, or of a section that is π-shaped.

2. The assembly according to claim 1, wherein the first sloping portion bears against an upper half of the attachment portion of each of the plurality of ring sectors, and wherein the second sloping portion bears against a lower half of the attachment portion of each of the plurality of ring sectors.

3. The assembly according to claim 1, wherein the first and second annular flanges of the ring support structure grip the attachment portion of each of the plurality of ring sectors over at least half of a length of said attachment portion.

4. The assembly according to claim 1, wherein the first and second annular flanges of the ring support structure grip the attachment portion of each of the plurality of ring sectors at least at a radially outer end thereof.

5. The assembly according to claim 1, wherein the attachment portion of each of the plurality of ring sectors is in a form of tabs extending radially.

6. The assembly according to claim 5, wherein radially outer ends of the tabs of each of the plurality of ring sectors do not come into contact and wherein the tabs of each of the plurality of ring sectors define therebetween an internal ventilation volume for each of the plurality of ring sectors.

7. The assembly according to claim 1, wherein the attachment portion of each of the plurality of ring sectors is in a form of a bulb.

8. A turbine engine including a turbine ring assembly according to claim 1.

9. The assembly according to claim 1, wherein each of the first and second annular flanges includes a third radial portion extending in the radial direction between the first sloping portion and the second sloping portion.

* * * * *